US008201810B2

(12) United States Patent
Svitavsky

(10) Patent No.: US 8,201,810 B2
(45) Date of Patent: Jun. 19, 2012

(54) KINEMATIC MOUNT

(75) Inventor: Peter V. Svitavsky, Port Byron, NY (US)

(73) Assignee: J.R. Clancy, Inc., Syracuse, NY (US)

( * ) Notice: Subject to any disclaimer, the term of this patent is extended or adjusted under 35 U.S.C. 154(b) by 357 days.

(21) Appl. No.: 12/688,289

(22) Filed: Jan. 15, 2010

(65) Prior Publication Data

US 2010/0237304 A1 Sep. 23, 2010

Related U.S. Application Data

(60) Provisional application No. 61/160,885, filed on Mar. 17, 2009.

(51) Int. Cl.
*B66D 1/00* (2006.01)

(52) U.S. Cl. ..... 254/329; 254/342; 254/332

(58) Field of Classification Search ..... 254/329, 254/332, 342
See application file for complete search history.

(56) References Cited

U.S. PATENT DOCUMENTS

| | | | | |
|---|---|---|---|---|
| 4,191,316 | A * | 3/1980 | Baumgartner | 414/462 |
| 4,493,479 | A | 1/1985 | Clark | |
| 4,796,862 | A | 1/1989 | Peppel | |
| 5,615,864 | A * | 4/1997 | Liebetrau et al. | 254/329 |
| 5,921,529 | A | 7/1999 | Wilson, Sr. et al. | |
| 5,947,639 | A * | 9/1999 | Bishop et al. | 405/3 |
| 6,089,547 | A | 7/2000 | Juelich et al. | |
| 7,090,200 | B2 * | 8/2006 | Morse et al. | 254/332 |
| 7,545,517 | B2 * | 6/2009 | Rueb et al. | 356/614 |
| 7,591,624 | B2 * | 9/2009 | Campbell et al. | 414/217 |
| 8,085,482 | B2 * | 12/2011 | Frankovich et al. | 359/824 |

FOREIGN PATENT DOCUMENTS

| | | |
|---|---|---|
| EP | 005329 | 6/1982 |
| KR | 2019870000803 | 2/1987 |

OTHER PUBLICATIONS

Pillow block bearing Wikipedia entry (http://e.wikipedia.org/wiki/Pillow_block_bearing as of May 5, 2009).

* cited by examiner

*Primary Examiner* — Emmanuel M Marcelo
(74) *Attorney, Agent, or Firm* — George R. McGuire; David B. Woycechowsky; Bond Schoeneck & King

(57) ABSTRACT

A cable-wound drum style hoist with a rotating shaft supported by bearings that has both: (i) some freedom of motion in (at least) one of the bearings; and (ii) a pillow block in the shaft to impart some freedom of motion (beyond freedom to rotate about the central axis) in the shaft itself. By allowing some freedom of motion both the bearing(s) and the shaft, the hoist can better accommodate for bent shafts and/or slight misalignment of coaxial bearings. Also, a set of preferred connection hardware for mechanically connecting a hoist reducer box to a hoist backbone with preferred degrees of freedom/constraint.

22 Claims, 13 Drawing Sheets

KINEMATIC MOUNT

RELATED APPLICATION

The present application claims priority to U.S. provisional patent application No. 61/160,885, filed on Mar. 17, 2009; all of the foregoing patent-related document(s) are hereby incorporated by reference herein in their respective entirety(ies).

BACKGROUND OF THE INVENTION

1. Field of the Invention

The present invention relates to hoists and more particularly to hoists including a backbone and a rotating, cable-wound drum.

2. Description of the Related Art

One conventional type of hoist includes a cable that is wound and unwound from a drum to move a load. An example of such a hoist is shown as hoist system 100 in FIG. 1. Hoist system 100 includes: building structure 102; hoist backbone 104; reducer connecting hardware set 105; motor 106; shaft 108; reducer assembly 110 (sometimes simply called, "the reducer"); cable 116; load 118; drum 120; and end bearing assembly 122. Co-ordinate axes set 101 shows the six degrees (or directions) of motion that various points in system 100 may have, including: (i) along X (that is, the direction into and out of the page); (ii) rotation about the X axis (or θX); (iii) along Y; (iv) rotation about the Y axis (or θY); (v) along Z; and (vi) rotation about the Z axis (or θZ). The reducer includes first bearing 112 and second bearing 114. The end bearing assembly includes third bearing 124. The shaft is constrained by the first, second and third bearings so that it is free to rotate in the θZ direction. The motor selectively drives, through the reducer, rotation of the shaft so that the cable is selectively wound and unwound to move the load through the cable.

In system 100: (i) the end bearing assembly (including the third bearing) is very rigidly and precisely located in space; (ii) the reducer (including the first and second bearings) is very rigidly and precisely located in space; and (iii) the shaft is made to be precisely co-axial with axis A1. Because of this precision and rigidity, the system works well. Unfortunately, it has been recognized that it is difficult to make all the components of system 100 so that they exhibit the precision and rigidity required for smooth operation. If there are variation from the above-noted types of precision and/or rigidity identified in this paragraph, then the shaft may be influenced to bend, as shown (in an exaggerated manner) by curved axis A2. If the shaft is bent, or stressed to bend by the bearings, in the bent direction of axis A2, then stresses and strains will cause, wear, damage and/or failure of the components of system 100. System 100 will not work well when the shaft is bent or stressed in the bending direction. As an example of the issues involved in giving system 100 the requisite degree of rigidity and precision, the backbone is precisely manufactured of very rigid material. As a further example of the issues involved in giving system 100 the requisite degree of rigidity and precision, reducer connecting hardware set 105 must rigidly and precisely connect the reducer, as well as bearings 112 and 114, to the backbone.

Because of the difficulty and/or expense in manufacturing hoist system components with the requisite degree of rigidity and/or precision, some conventional systems allow the bearings that constrain the shaft to have certain degrees (or directions) and quanta of freedom of motions. One conventional example, shown in FIG. 2, is shaft mounting hoist system 200. Hoist system 200 includes: building structure 202; hoist backbone 204; reducer connecting hardware set 205; motor 206; shaft 208; reducer 210 (sometimes simply called "the reducer"); cable 216; load 218; drum 220; end bearing assembly 222; and intermediate bearing assembly 224. Co-ordinate axes set 201 shows the six degrees (or directions) of motion that various points in system 200 may have. The reducer includes first bearing 212 and second bearing 214. The end bearing assembly includes third bearing 224. The intermediate bearing assembly includes pillow block bearing 228. The shaft is constrained by the first, second and third bearings so that it is free to rotate in the θZ direction. The motor selectively drives, through the reducer, rotation of the shaft so that the cable is selectively wound and unwound to move the load through the cable.

In shaft mounting hoist system 200, the reducer connecting hardware set connects the reducer assembly to the backbone so that degrees and freedom/constraint are determined with respect to a constraint point (see DEFINITIONS section). More specifically, the constraint point has the following degrees of freedom/constraint, relative to the backbone: (i) free in along X; (ii) free in rotation about X; (iii) fixed in along Y; (iv) free in rotation about Y; (v) free in along Z; and (vi) free in rotation about Z. In other words, the reducer connecting hardware set is further structured so that the constraint point is only rigidly constrained (relative to the backbone) in the along-Y direction, and this constraint point must be offset from the axis of rotation in the along-X direction. Alternatively, the sole direction of constraint can be in a different direction, such as along-X, but the important thing to keep in mind is that there is only a single direction of tension/compression type constraint. The constraint point in the shaft mounting type hoist design is otherwise free to move relative to the backbone.

In the shaft mounting type hoist design, the pillow block bearings (see DEFINITIONS section) each place the following degrees of freedom/constraint on shaft 208: (i) fixed in along X; (ii) free in rotation about X; (iii) fixed in along Y; (iv) free in rotation about Y; (v) fixed in along Z; and (vi) free in rotation about Z. preferably bearings 212 and 214 are "rigid bearings" (see DEFINITIONS section).

Because of the above-identified distribution of degrees of freedom/constraint in the reducer constraint point and on shaft at the locations of the pillow bearings, the shaft mounting type hoist system 200 is free to move so it can accommodate some shaft bending (see FIG. 1 at axis A2) and/or some imprecision in the coaxial alignment of the bearings 212, 214, 224, 228. This accommodation makes shaft mounting an advantageous type of design from a kinematic perspective.

Another conventional hoist system is shown in U.S. Pat. No. 4,796,862 ("Peppel"). The Peppel winch includes a pillow block bearing 30 which allows the shaft some degree of freedom of motion with respect to its axis. This is another way to reduce the requisite degree of rigidity and precision of components when making and assembling a hoist.

Other publications which may be of interest may include the following: (i) pillow bock bearing Wikipedia entry (http://e.wikipedia.org/wiki/Pillow_block_bearing as of May 5, 2009); (ii) U.S. Pat. No. 6,089,547 ("Juelich"); and/or (iii) U.S. Pat. No. 5,921,529 ("Wilson").

Description of the Related Art Section Disclaimer: To the extent that specific publications are discussed above in this Description of the Related Art Section, these discussions should not be taken as an admission that the discussed publications (for example, published patents) are prior art for patent law purposes. For example, some or all of the discussed publications may not be sufficiently early in time, may not reflect subject matter developed early enough in time and/or may not be sufficiently enabling so as to amount to prior art for patent law purposes. To the extent that specific publications are discussed above in this Description of the Related Art Section, they are all hereby incorporated by reference into this document in their respective entirety(ies).

BRIEF SUMMARY OF THE INVENTION

According to the present invention, a hoist system includes at least two spaced apart bearings that are supported by a frame. The bearings support a rotating shaft segment. One of the bearings is a pillow block bearing that is rigidly connected to the frame (either directly or through intermediate hardware). The other bearing is part of a bearing assembly that is connected to the frame by assembly connection hardware. The assembly connection hardware is shaped, sized, located and/or connected so that it supports the bearing assembly (including its bearing(s)) in a way that has certain, carefully chosen, degrees of freedom and constraint. These degrees of constraint are defined with respect to a first and a second "constraint point" (see DEFINITIONS section). More specifically, the assembly connection hardware is sized, shaped, located and/or connected so that the first constraint point and the second constraint point have the following degrees of freedom and constraint: (i) first constraint point fixed or free in along X (see FIG. 3 for the co-ordinate axes); (ii) first constraint point free in rotation about X; (iii) first constraint point fixed in along Y; (iv) first constraint point free in rotation about Y; (v) first constraint point free in along Z; (vi) first constraint point free in rotation about Z; (vii) second constraint point fixed in along X; (viii) second constraint point free in rotation about X; (ix) second constraint point fixed in along Y; (x) second constraint point free in rotation about Y; (xi) second constraint point free in along Z; and (xii) second constraint point free in rotation about Z. The shaft is located, sized and shaped to be supported and constrained by (at least) the first bearing and the pillow block bearing. Preferably, bearing(s) present in the bearing assembly is/are rigid bearing (s) (see DEFINITIONS section).

As an alternative way of looking at or defining the kinematics of hoists according to the present invention the assembly connection hardware is sized, shaped, located, and/or connected such that it will transmit, from the bearing assembly to the frame, forces parallel with the X axis, forces parallel with the Y axis, and moments about the Z axis. The mechanism will not transmit forces in the Z direction, moments about the X axis, or moments about the Y axis. Note that by fixing the X and Y translational degrees of freedom the assembly connection hardware can provide sufficient stability for the shaft and the bearing assembly. Also, by fixing moments about the Z axis it transmits to the frame the torsion due to the lifted load of the hoist. However, by not fixing the X and Y rotational degrees of freedom the bearing assembly is free to rotate to accommodate deviations in the straightness of the shaft caused by manufacturing imperfections or deflection due to loading. Furthermore, by not fixing these degrees of freedom the requirements for manufacturing precision required to mount the shaft and bearing assembly are reduced and the forces imposed on the shaft may be more accurately predicted.

Various embodiments of the present invention may exhibit one or more of the following objects, features and/or advantages:

(i) less expensive hoist assembly;

(ii) more durable hoist assembly;

(iii) hoist assembly that better accommodates for a bent shaft or shaft segment; and/or (iv) hoist assembly that better accommodates for slight misalignment of coaxial bearings.

According to one aspect of the present invention, a hoist system defines X, Y and Z directions. The system includes: a frame, a first shaft segment, a first bearing assembly, a first-assembly connection hardware set and a second bearing assembly. The first bearing assembly is mechanically connected to the frame by the first-assembly connection hardware set. The first bearing assembly comprises a first bearing. The second bearing assembly is rigidly mechanically connected to the frame. The second bearing assembly comprises a second bearing located to be spaced apart from the first bearing. The second bearing is a pillow block bearing. The first bearing and the second bearing are shaped, sized and located to support and constrain the first shaft segment so that the first shaft segment is free to rotate about the Z direction. The first-assembly connection hardware set defines a first constraint point and a second constraint point spaced apart from the first constraint point. The first-assembly connection hardware set is sized, shaped, located and/or connected so that the first bearing assembly has, relative to the frame and with respect to the first constraint point, the following degrees of freedom/constraint: (i) fixed or free in along X; (ii) free in rotation about X; (iii) fixed in along Y; (iv) free in rotation about Y; (v) free in along Z; (vi) free in rotation about Z. The first-assembly connection hardware set is further sized, shaped, located and/or connected so that the first bearing assembly has, relative to the frame and with respect to the second constraint point, the following degrees of freedom/constraint: (i) fixed in along X; (ii) free in rotation about X; (iii) fixed in along Y; (iv) free in rotation about Y; (v) free in along Z; and (vi) free in rotation about Z.

According to a further aspect of the present invention, a hoist system defines X, Y and Z directions. The system includes: a frame, a first shaft segment, a first bearing assembly, a first-assembly connection hardware set, a second bearing assembly, a second shaft segment and a shaft coupling hardware set. The first bearing assembly is mechanically connected to the frame by the first-assembly connection hardware set. The first bearing assembly comprises a first bearing. The second bearing assembly is rigidly mechanically connected to the frame. The second bearing assembly comprises a second bearing located to be spaced apart from the first bearing. The second bearing is a pillow block bearing. The first bearing and the second bearing are shaped, sized and located to support and constrain the first shaft segment so that the first shaft segment is free to rotate about the Z direction. The first-assembly connection hardware set defines a first constraint point and a second constraint point spaced apart from the first constraint point. The first-assembly connection hardware set is sized, shaped, located and/or connected so that the first bearing assembly has, relative to the frame and with respect to the first constraint point, the following degrees of freedom/constraint: (i) fixed or free in along X; (ii) free in rotation about X; (iii) fixed in along Y; (iv) free in rotation about Y; (v) free in along Z; and (vi) free in rotation about Z. The first-assembly connection hardware set is further sized, shaped, located and/or connected so that the first bearing assembly has, relative to the frame and with respect to the second constraint point, the following degrees of freedom/constraint: (i) fixed in along X; (ii) free in rotation about X; (iii) fixed in along Y; (iv) free in rotation about Y; (v) free in along Z; and (vi) free in rotation about Z. The shaft coupling hardware set couples the first shaft segment and the second shaft segment so that they rotate together about the Z direction. The shaft coupling hardware transmits only radial loads and loads in torsion.

According to a further aspect of the present invention, a hoist system defines X, Y and Z directions, the system includes: a backbone, a motor, a hoist hardware set, a first shaft segment, a motor-end bearing assembly, a motor-end-assembly connection hardware set and a pillow block bearing assembly. The hoist hardware set is mechanically connected to an end of the first shaft segment. The motor is rigidly mechanically connected to the motor end bearing assembly. The motor is structured, located and/or connected to drive the first shaft segment to rotate about Z. The motor-end bearing assembly is mechanically connected to the backbone by the motor-end-assembly connection hardware set. The motor-end bearing assembly comprises a first motor-end bearing and a second motor-end bearing. The intermediate bearing assembly is rigidly mechanically connected to the backbone. The intermediate bearing assembly comprises a pillow block bearing located to be spaced apart from, and at least substantially co-axial with, the first motor end-end bearing and the second motor-end bearing. The pillow block bearing, the first motor-end bearing and the second motor-end bearing are shaped, sized and located to support and constrain the first shaft segment so that the first shaft segment is free to rotate about the Z direction. The motor-end-assembly connection hardware set defines a first constraint point and a second constraint point spaced apart from the first constraint point. The motor-end-assembly connection hardware set is sized, shaped, located and/or connected so that the motor-end bearing assembly has, relative to the backbone and with respect to the first constraint point, the following degrees of freedom/constraint: (i) fixed or free in along X; (ii) free in rotation about X; (iii) fixed in along Y; (iv) free in rotation about Y; (v) free in along Z; and (vi) free in rotation about Z. The motor-end-assembly connection hardware set is further sized, shaped, located and/or connected so that the first bearing assembly has, relative to the backbone and with respect to the second constraint point, the following degrees of freedom/constraint: (i) fixed in along X; (ii) free in rotation about X; (iii) fixed in along Y; (iv) free in rotation about Y; (v) free in along Z; and (vi) free in rotation about Z.

According to a further aspect of the present invention, a hoist system defines X, Y and Z directions. The system includes: a frame, a first shaft segment, a first bearing assembly, a first-assembly connection hardware set and a second bearing assembly. The first bearing assembly is mechanically connected to the frame by the first-assembly connection hardware set. The first bearing assembly comprises a first bearing. The second bearing assembly is rigidly mechanically connected to the frame. The second bearing assembly comprises a second bearing located to be spaced apart from the first bearing. The second bearing is a pillow block bearing. The first bearing and the second bearing are shaped, sized and located to support and constrain the first shaft segment so that the first shaft segment is free to rotate about the Z direction. The first-assembly connection hardware set defines a first constraint point and a second constraint point spaced apart from the first constraint point. The first-assembly connection hardware set is sized, shaped, located and/or connected so that such that it will transmit, from the first bearing assembly to the frame, forces parallel with the X axis, forces parallel with the Y axis, and moments about the Z axis. The first-assembly connection hardware set is further sized, shaped, located and/or connected so that such that it will not transmit forces in the Z direction, moments about the X axis, or moments about the Y axis.

According to a further aspect of the present invention, a method of hoisting an object includes the following steps i, ii, etc. (not necessarily in the following order): (i) providing a hoist system defining X, Y and Z directions, the system including: a frame, a first shaft segment, a first bearing assembly, a first-assembly connection hardware set and a second bearing assembly, wherein: (a) the first bearing assembly is mechanically connected to the frame by the first-assembly connection hardware set, (b) the first bearing assembly comprises a first bearing, (c) the second bearing assembly is rigidly mechanically connected to the frame, (d) the second bearing assembly comprises a second bearing located to be spaced apart from the first bearing, (e) the second bearing is a pillow block bearing, (f) the first bearing and the second bearing are shaped, sized and located to support and constrain the first shaft segment so that the first shaft segment is free to rotate about the Z direction, and (g) the first-assembly connection hardware set defines a first constraint point and a second constraint point spaced apart from the first constraint point; (ii) hoisting a load so that: (a) the first constraint point is free in rotation about X; (b) the first constraint point is fixed in along Y; (c) the first constraint point is free in rotation about Y; (d) the first constraint point is free in along Z; (e) the first constraint point is free in rotation about Z; (f) the second constraint point is fixed in along X; (g) the second constraint point is free in rotation about X; (h) the second constraint point is fixed in along Y; (i) the second constraint point is free in rotation about Y; (j) the second constraint point is free in along Z; and (k) the second constraint point is free in rotation about Z.

BRIEF DESCRIPTION OF THE DRAWINGS

The present invention will be more fully understood and appreciated by reading the following Detailed Description in conjunction with the accompanying drawings, in which.

DETAILED DESCRIPTION OF THE INVENTION

Figure 1:
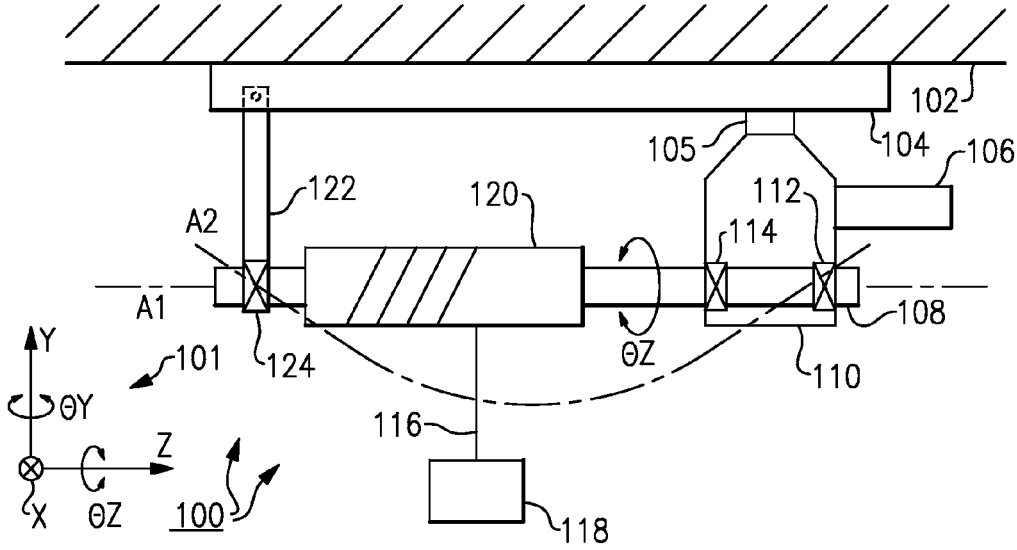
FIG.1 Prior Art
FIG. 1 is a side view of a first conventional hoist system.

FIGS. 3 to 7 (with co-ordinate axes 301) show hoist system 300 according to the present invention, including: building structure 302; hoist backbone 304; first connection hardware set 305; motor 306; first shaft segment 308; second shaft segment 309; motor-end bearing assembly 310; cable 316; load 318; drum 320; drum-end bearing assembly 322; intermediate bearing assembly 313; and shaft coupling hardware set 330. The motor-end bearing assembly includes first motor-end bearing 312 and second motor-end bearing 314. The drum-end bearing assembly includes drum-end bearing 324. The intermediate bearing assembly includes pillow block bearing 311. Although system 300 is a cable-bearing drum type hoist, the present invention could be used with other types of hoists, such as chain-and-sprocket type hoists. Although drum-end bearing 324 is shown as a rigid bearing, in many preferred embodiments (and especially in embodiments where the drum end bearing assembly is rigidly connected to the frame), the drum-end bearing will preferably be a spherical roller bearing so the engagement with the bearing allows the shaft to be self-aligning.

Figure 7:
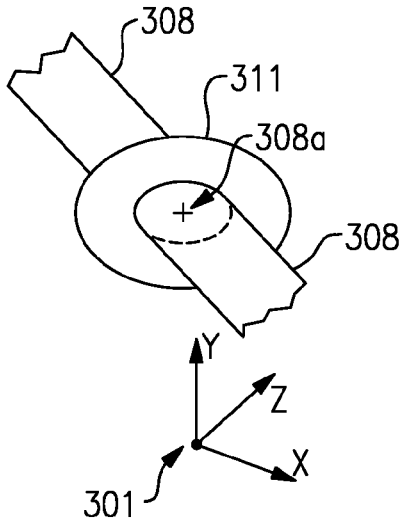
FIG. 7 is a perspective view of a portion of the first embodiment system.

One important aspect of the kinematic mount of system 300 is its pillow block, and another aspect is its first connection hardware set. The pillow block will be discussed first. Pillow block 311 may be any type of pillow block now known or to be developed in the future. The pillow block constrains one end of rotating shaft segment 308, specifically the end where it is coupled to second shaft segment 309 by shaft coupling hardware set 330. More particularly, FIG. 7 shows a constraint point 308*a* in shaft 308 that is useful for describing exactly how the pillow block bearing constraint shaft segment 308. The pillow block bearing (which is rigidly constrained to the backbone by a connection hardware set (not separately shown or numbered)) constrains shaft segment 308 so tat constraint point 308*a* has the following relative degrees of freedom/constraint: (i) along-X fixed; (ii) along-Y fixed; (iii) along-Z fixed; (iv) θX free; (v) θY free; and (vi) θZ fixed.

Figure 4:
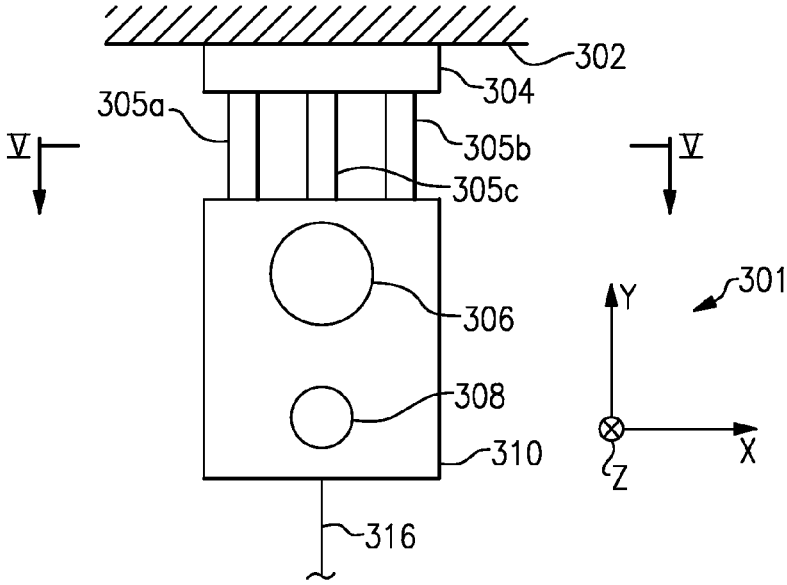
FIG. 4 is an end view of a portion of the first embodiment system.
Figure 5:
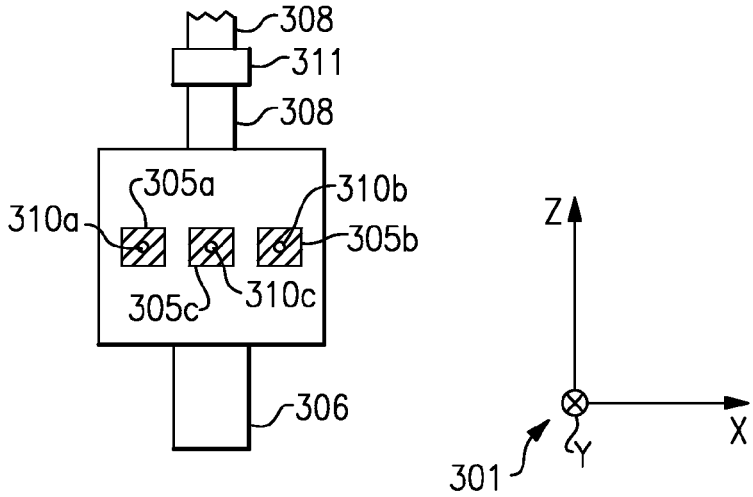
FIG. 5 is a cross-sectional view of a portion of the first embodiment system.
Figure 6:
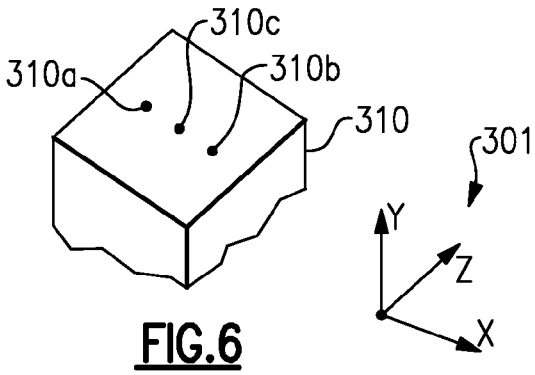
FIG. 6 is a cross-sectional, perspective view of a portion of the first embodiment system.

Motor-end bearing assembly 310 is mechanically connected to the backbone by first connection hardware set 305, which provides certain degrees of freedom/constraint with respect to two constraint points, as will now be discussed. As shown in FIGS. 4 and 5, motor-end connection hardware set 305 includes three (3) connectors 305*a*, 305*b*, 305*c*. As shown at FIGS. 5 and 6, the connection between the motor-end connection hardware set and the motor-end bearing assembly define three (3) possible constraint points 310*a*, 310*b* and 310*c*. Connector 305*c* and its associated constraint point 310*c* only provide constraint in cases of kinematic malfunction and/or failure. For this reason, connector 305*c* and its associated constraint point is a safety contingency, and not of kinematic interest when analyzing normal operations of system 300. Motor-end connection hardware set 305 is structured, located and/or connected so that constraint point 310*a* has the following degrees of freedom/constraint relative to the backbone: (i) along-X free; (ii) along-Y fixed; (iii) along-Z free; (iv) θX free; (v) θY free; and (vi) θZ free. Motor-end connection hardware set 305 is structured, located and/or connected so that constraint point 310*b* has the following degrees of freedom/constraint relative to the backbone: (i) along-X free; (ii) along-Y fixed; (iii) along-Z free; (iv) θX free; (v) θY free; and (vi) θZ free. In this preferred embodiment, the line between constraint points 310*a* and point 310*b* is perpendicular to the axis of rotation defined by the shaft and bearings (that is, the Z axis), but this is not necessarily required. In this preferred embodiment, point 310*a* and point 310*b* are equally spaced apart from the axis of rotation, but this is not necessarily required. Any moments about the Z axis experienced by shaft 308 are transmitted by some mechanism through motor-end connection hardware set 305 to the hoist frame. This function is performed by a gear train (not shown) and motor 306, which are part of the motor end bearing assembly.

In system 300, the motor-end bearing assembly itself is rigid. Preferably, it helps serve as a housing for a reducer hardware set (not shown) and as a mounting bracket for motor 306. Preferably, first motor-end bearing and second motor-end bearing are rigid bearings, but this is not necessarily required. Also, some embodiments of the present invention may have a single bearing in the motor end bearing assembly. As a further variation, the kinematically-optimized constraints used in the motor-end assembly do not necessarily need to be at the motor end of the hoist—indeed some embodiments of the present invention may not have a motor at all. For example, the drum-end bearing assembly 322 could be kinematically mounted instead of (or in addition to) the motor-end bearing assembly.

Shaft coupling hardware set 330 couples shaft segments 308 and 309 so that these shaft segments rotate together. More specifically, the shaft coupling hardware set transmits loads in torsion and radial loads, but is otherwise allows relative motion between the ends of the shaft segments 308 and 309. In a variation on system 300, the drum-end bearing could be replaced with a pillow block and the intermediate bearing assembly and the shaft coupling hardware could be omitted so that a single shaft segment is used. System 300 is a shaft that uses a cable-wound drum as its hoist hardware, but other embodiments may use other types of rotating hoist hardware, such as chain-and-sprocket type hoist hardware.

Figure 8:
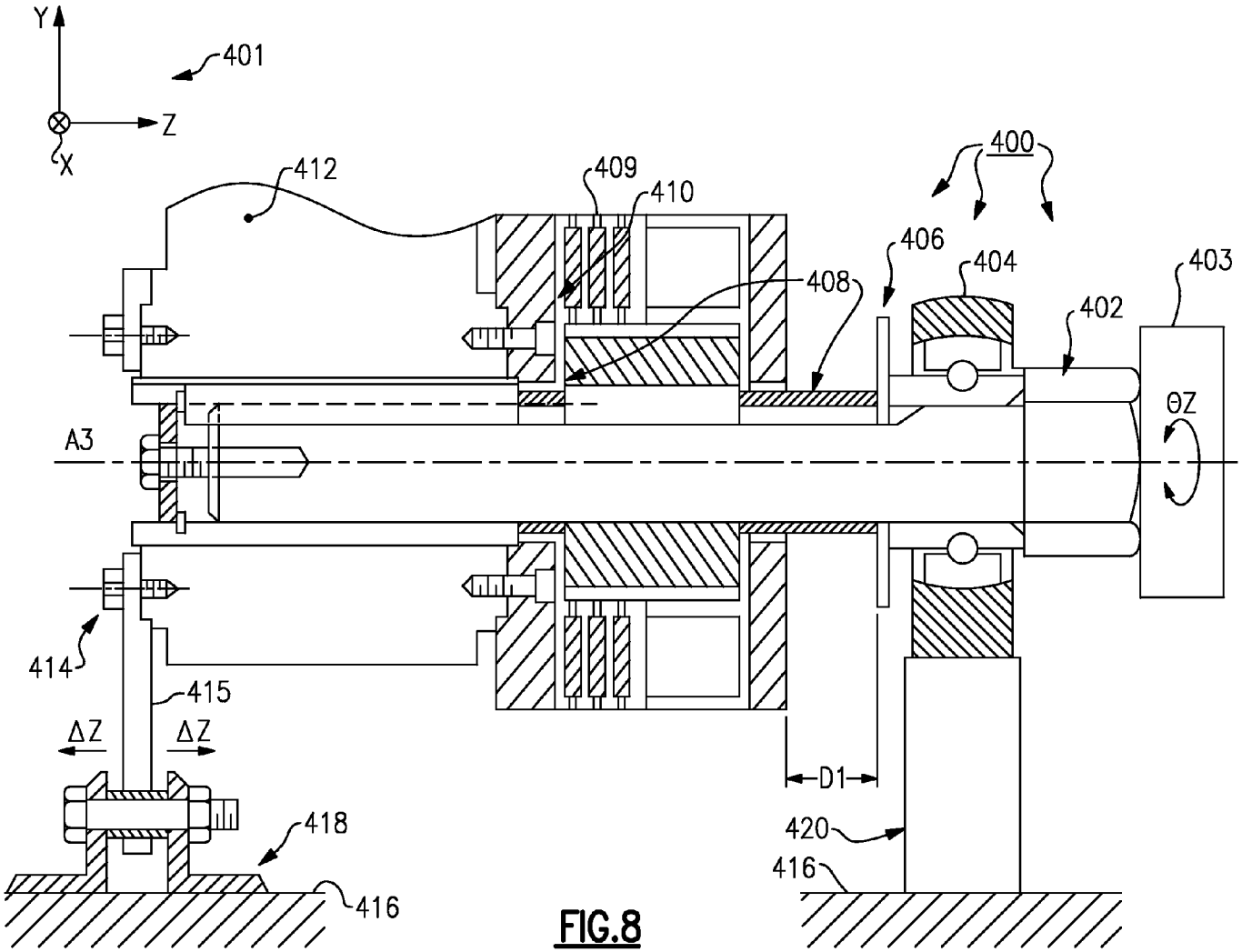
FIG. 8 is a cross-sectional, side view of a second embodiment of a hoist system according to the present invention.

FIG. 8 shows hoist system 400 (and associated co-ordinate axes 401), the system including: hexagonal bore-and-shaft coupling 402; hoist hardware 403; pillow block bearing 404; toothed wheel 406; shaft spacers 408; brake 409; brake securing bolt 410; reducer box 412 (also known as motor-end bearing assembly); rear plate securing bolt 414; rear plate 415; frame (or backbone) 416; reducer box connection hardware set 418; and pillow block connection hardware set 420. Dimension D1 is small. Coupling 402 preferably includes a diameter 1.5 hex head shaft end. The kinematics of system 400 are similar to those discussed above in connection with system 300. More particularly: (i) the motor-end bearing assembly is mechanically connected to the frame by the reducer box connection hardware set so that it has the similar constraint point and degrees of constraint/freedom as discussed above in connection with motor-end connection hardware set 305; and (ii) pillow block bearing 404 provides similar constraint and freedom for the shaft (not separately numbered in FIG. 8) as discussed above in connection with pillow block bearing 311. Hoist hardware 403 preferably includes a rotating cable wound drum, but could instead have hardware for other hoists types (now known or to be developed in the future).

Figure 18:
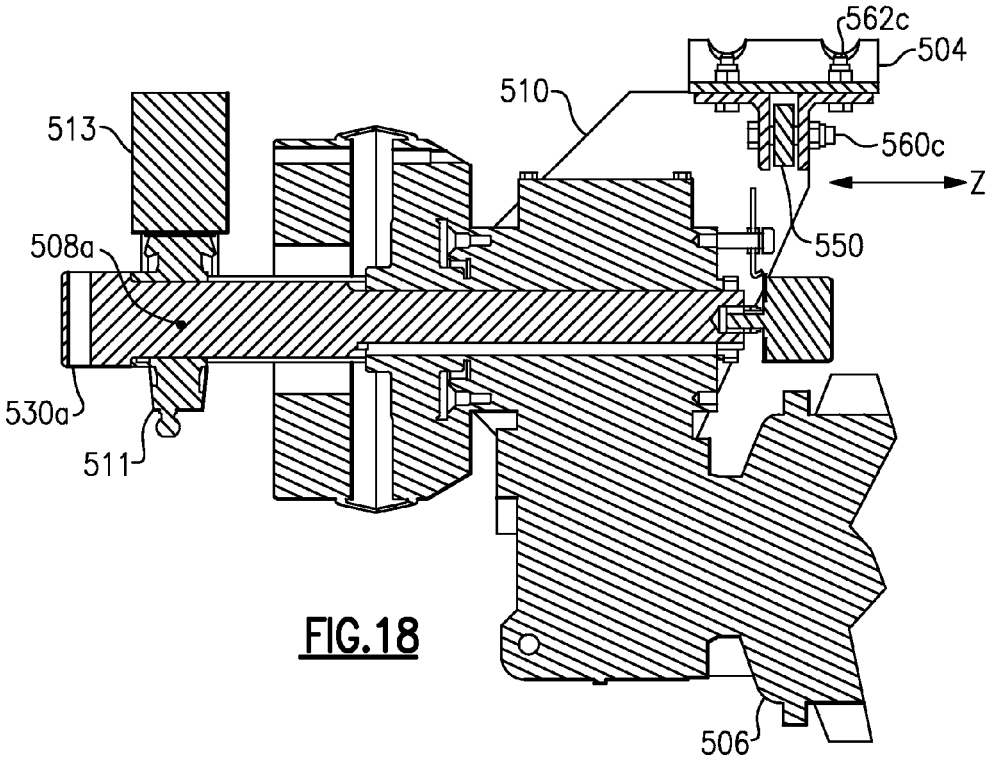
FIG. 18 is a cross-sectional view of a portion of the third embodiment system.
Figure 19:
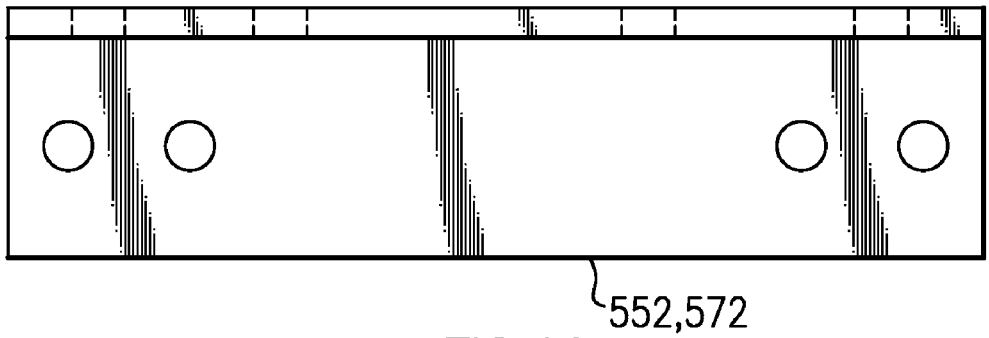
FIG. 19 is a top view of a component of the third embodiment system.
Figure 20:
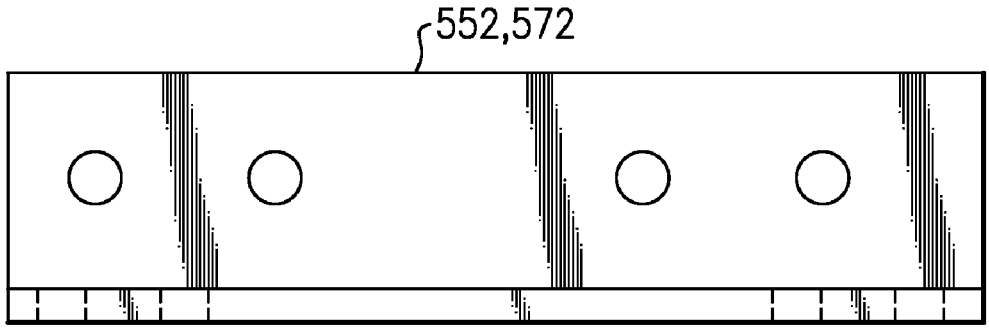
FIG. 20 is a side view of a component of the third embodiment system.
Figure 22:
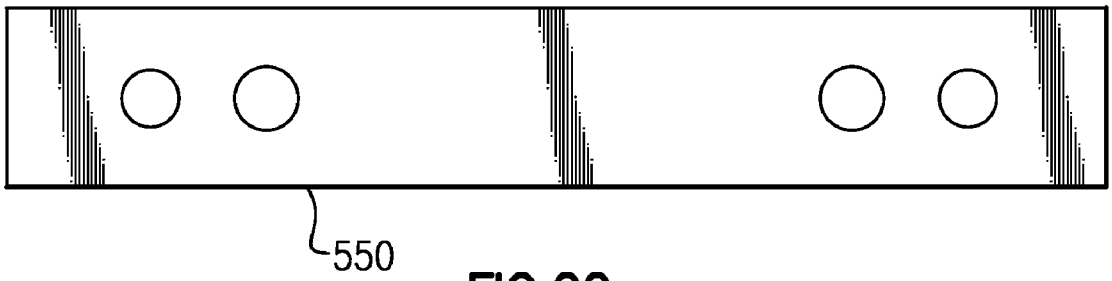
FIG. 22 is an end view of a component of the third embodiment system.
Figure 21:
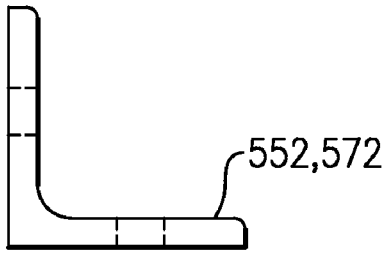
FIG. 21 is a bottom view of a component of the third embodiment system.
Figure 23:
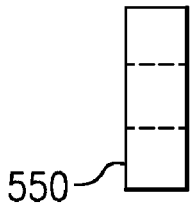
FIG. 23 is a side view of a component of the third embodiment system.

FIGS. 9 to 24 show hoist system 500 (and associated coordinate axes 501), the system including: shipping tag 503; backbone 504; motor-end connection hardware set 505; motor 506; first shaft segment 508; second shaft segment 509; motor-end bearing assembly 510; intermediate bearing assembly 513; drum 520; drum-end bearing assembly 522; hexagonal shaft-and-bore coupling hardware set 530. The motor-end connection hardware set includes: mounting bar 550; motor-side bracket 552 (or alternative motor-side bracket 553); nut-bolt assemblies 560*a,b,c,d*; nut-bolt assemblies 562*a,b,c,d*; bushings 564; and drum-side bracket 572. Intermediate bearing assembly 513 includes pillow block bearing 511. The drum-end bearing, which is supported by drum-end bearing assembly 522 is not shown in FIG. 9 because it is hidden away inside drum 520 in the vicinity of reference point 510. As shown in FIGS. 12 and 18, hexagonal shaft-and-bore coupling 530 includes motor-side coupling hardware 530*a*. The mechanical interface between shaft segment 508 and pillow block 511 define shaft constraint point L, as shown in FIG. 12. The mechanical interface between bushings 564 and mounting bar 550 define first bearing assembly constraint point M and second bearing assembly constraint point N, as shown in FIG. 11C.

The intermediate bearing assembly and its pillow block bearing provide similar freedom and constrain to shaft constraint point L (see FIG. 12) as the pillow block bearing discussed in connection with system 300. The pillow block bearing may be constructed as, for example, the UCP200 Series of pillow blocks made by Peer Inc. (see, http://www-.peerinc.com/). Hexagonal shaft-and-bore coupling hardware set 530 provides similar freedom and constraint between shaft segments as coupling 330 discussed above in connection with system 300.

Motor-end connection hardware set 505 will now be discussed. Generally speaking, motor-end connection hardware set 505 is structured, located and connected to provide similar freedom and constraint for the motor-end bearing assembly (with respect to constraint points M and N) as motor-end connection hardware set 305, discussed above in connection with system 300. Kinematically speaking, the one variation, is that the use of bracket piece shown in FIG. 11A will mean that both constraint points are fixed in the along-X direction, whereas on of the bearing assembly constraint points is free in the along-X direction in system 300. However, if the bracket piece of FIG. 11A is replaced with the bracket piece of FIG. 11B, then the degrees of constraint and freedom will be the same as those discussed above in connection with system 300. That is because alternative motor-side bracket includes slot 553*e*, which is elongated in the along-X direction.

Figure 10:
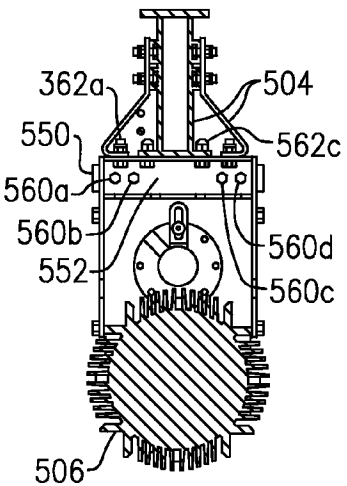
FIG. 10 is a cross-sectional view of the third embodiment system.
Figure 11A:
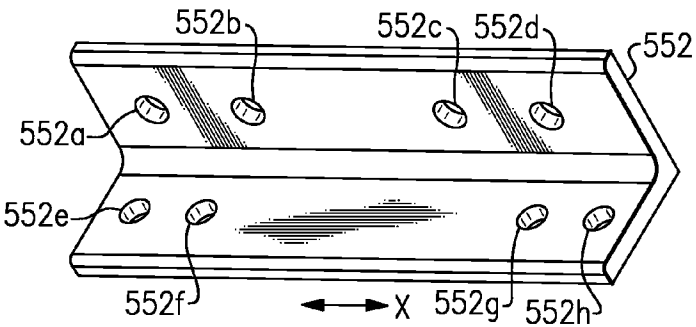
FIG. 11A is a perspective view of a component of the third embodiment system.
Figure 11B:
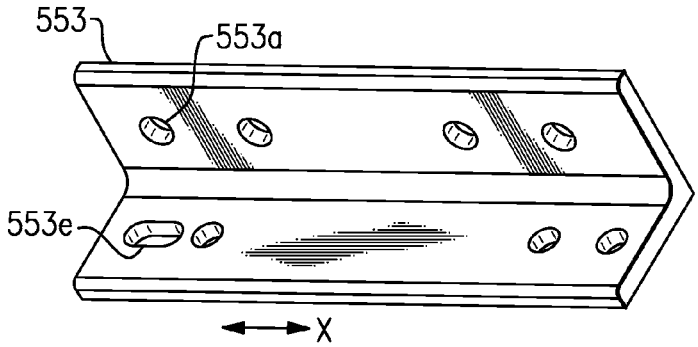
FIG. 11B is a perspective view of a component of a variation on the third embodiment system.
Figure 11C:
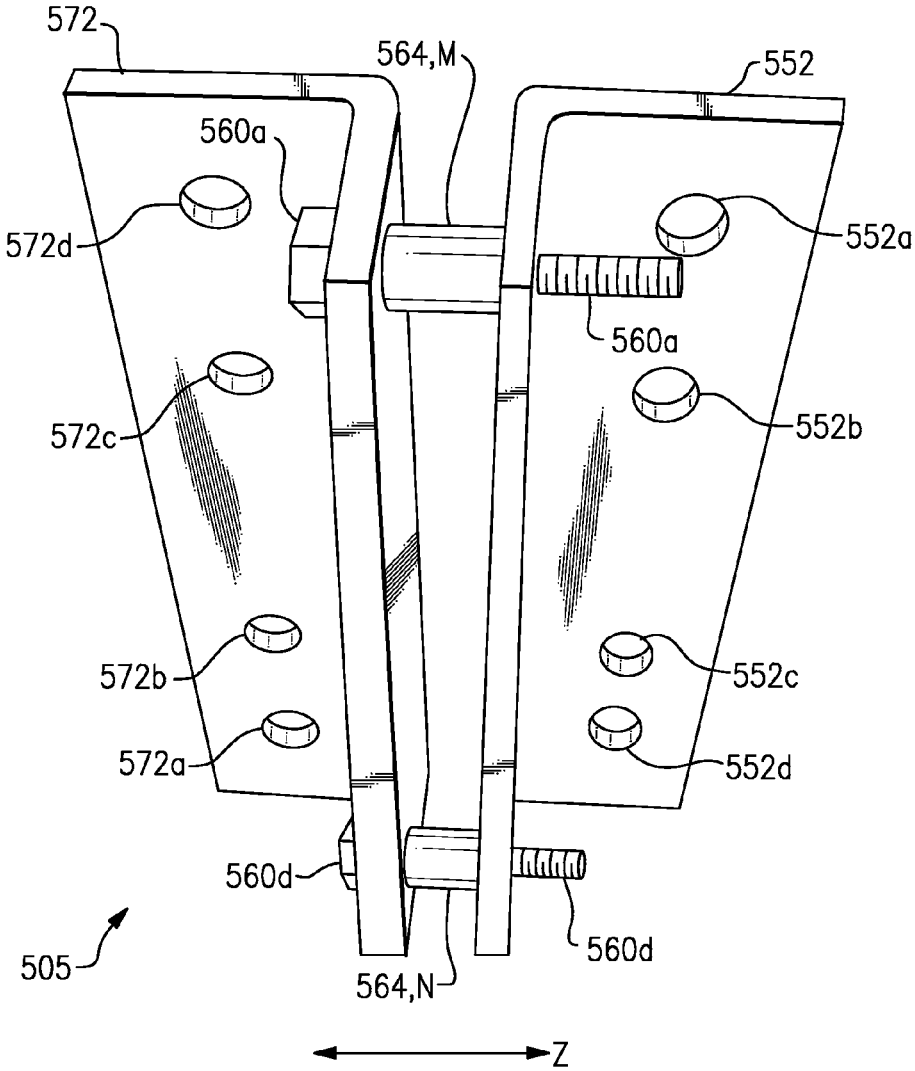
FIG. 11C is a perspective view of a portion of the third embodiment system.
Figure 12:
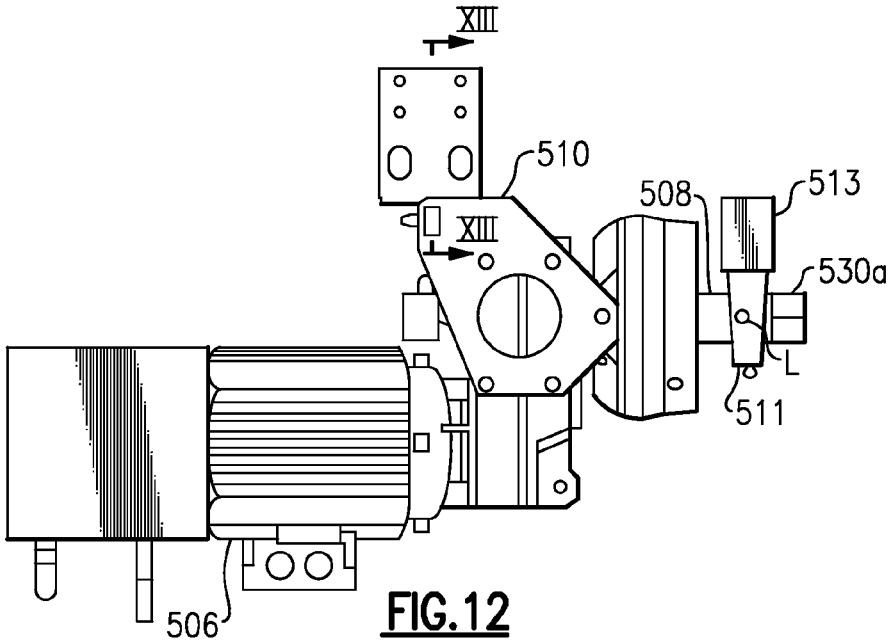
FIG. 12 is a side view of a portion of the third embodiment system.

As best shown in FIGS. 10 and 11C, motor-side bracket 552 of motor-end connection hardware set 505 includes holes 552*a,b,c,d* to accommodate respective nut-bolt assemblies 562*a,b,c,d* in order to rigidly mechanically connect bracket 552 to frame 504. Drum-side bracket 572 includes similar holes and is rigidly connected to the frame in a similar way so that the motor-side bracket and the drum-side bracket face and oppose each other, across a gap in the along Z direction, as shown in FIG. 11C. As further shown in FIGS. 11C, 13 and 14, two (2) bushings 564 are secured across this gap, respectively by nut-bolt assemblies 560*a* and 560*d*, which are respectively accommodated by: (i) holes 552*e* and 552*h* in motor-side bracket 552; (ii) corresponding holes (not shown or numbered) in the drum-side bracket; and (iii) holes 550*a* and 550*d* in mounting bar 550. These bushings provide a mechanical interface for mounting bar 550, as best shown in FIG. 18. As will be explained below, the mounting bar is rigidly mechanically connected to the motor-end bearing assembly. Because of the way the mechanical interface between the bushings and the mounting bar is sized, shaped and located, it provides the degrees of freedom and constraint for constraint points M and N as discussed above. Because of the specific degrees of freedom and constraint provided by motor-end connection hardware set 505, pillow block 511 and hexagonal shaft-and-bore coupling 530, system 500 can accommodate bent shafts and/or misalignment in coaxiality of the bearing in an advantageous way.

Figure 14:
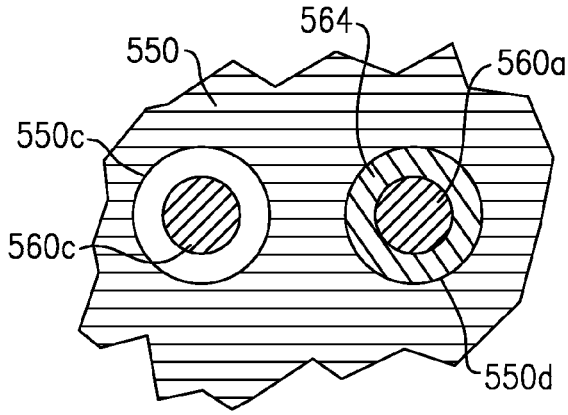
FIG. 14 is a detail view of a portion of the view of FIG. 13.
Figure 13:
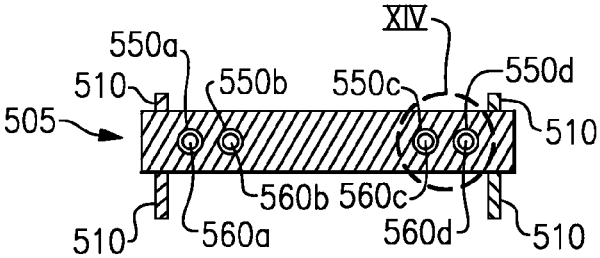
FIG. 13 is a cross-sectional view of a portion of the third embodiment system.

As shown in FIGS. 11A, 13, 14, bracket 552 further includes holes 552*f* and 552*g* to respectively accommodate nut-bolt assemblies 560*b* and 560*c*. As shown in FIG. 14, there is clearance between the bolts 560*b* and 560C and the corresponding holes 550*b* and 550*c* in motor mounting bar 550. This means that there is normally no mechanical interface and no kinematic constraint at these locations. Rather, nut-bolt assemblies 560*b,c* are only present in case of failure of nut-bolt assemblies 560*a* and/or 560*d*.

Figure 15:
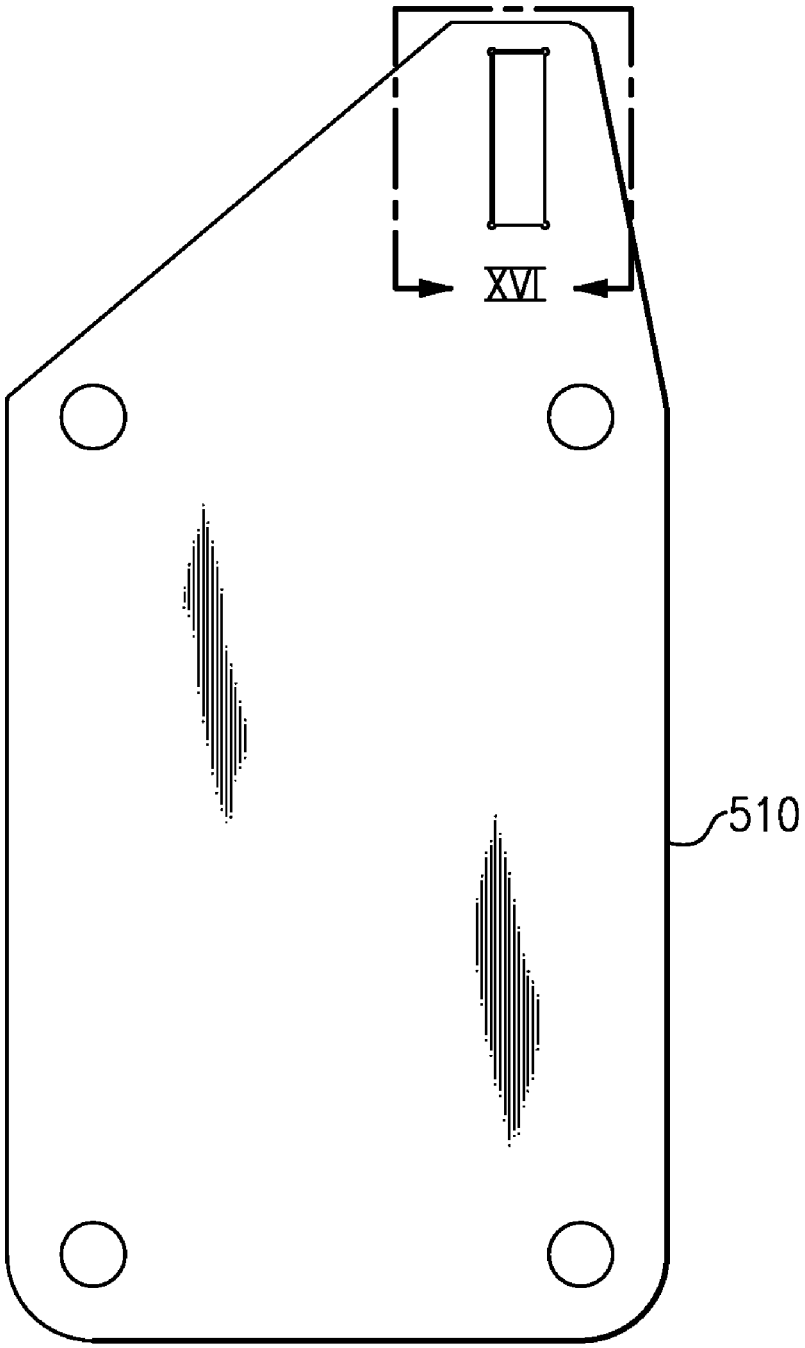
FIG. 15 is a side view of a component of the third embodiment system.
Figure 16:
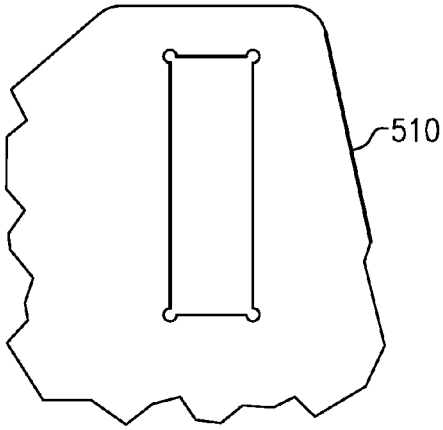
FIG. 16 is a detail view of a portion of the view of FIG. 15.
Figure 17:
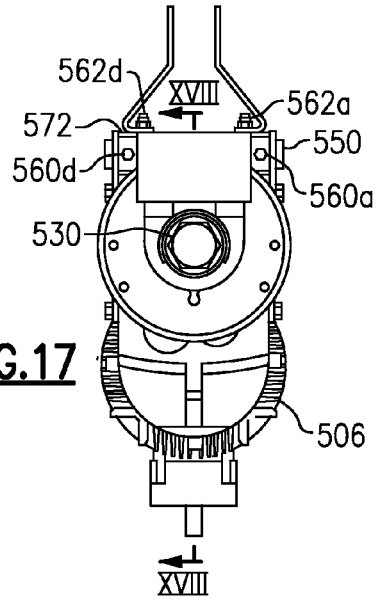
FIG. 17 is a drum-end view of a portion of the third embodiment system.

As best shown in FIGS. 15 and 16, the mounting bar is welded into corresponding holes in motor-end bearing assembly 510 to provide a rigid mechanical connection therebetween. Alternatively, there could be some degree(s) of freedom between the motor-end connection hardware set and the motor-end bearing assembly, but this is not necessarily preferred. There may be some degree(s) of freedom within the motor-end bearing assembly itself or between the motor end bearing assembly and the bearing(s) (not shown or numbered), but, again, this is not necessarily preferred.

Figure 24:
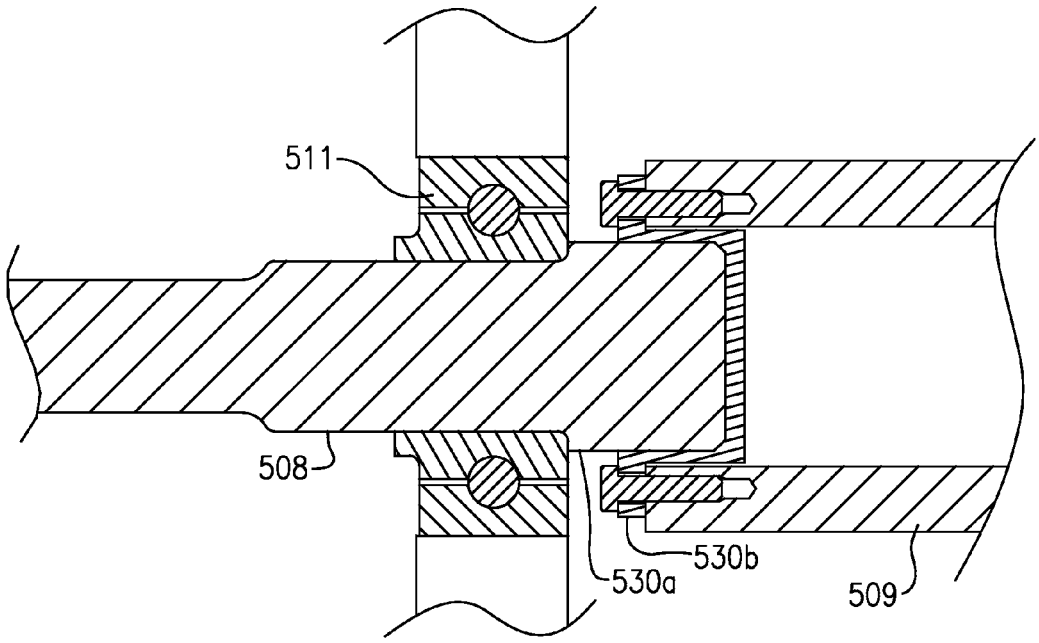
FIG. 24 is a side view in partial section of a portion of the third embodiment system.
Figure 25:
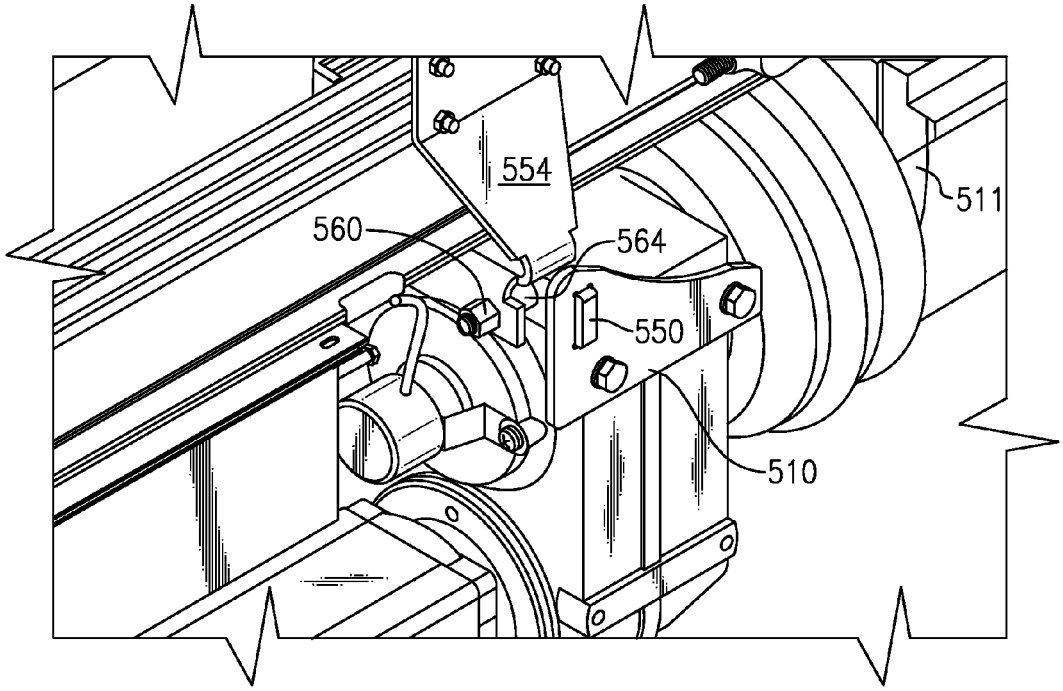
FIG. 25 is a perspective detail view of a variation on the third embodiment system that uses component 554 in place of components 552 and 572.
Figure 27:
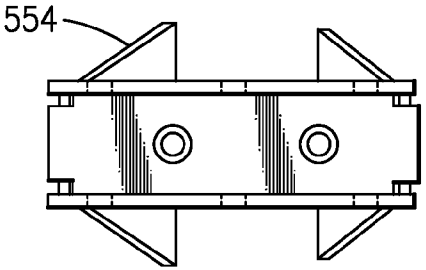
FIG. 27 is an orthographic top view of component 554.
Figure 26:
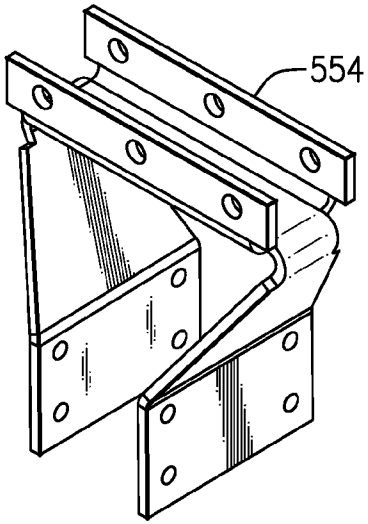
FIG. 26 is a perspective view of component 554.
Figure 30:
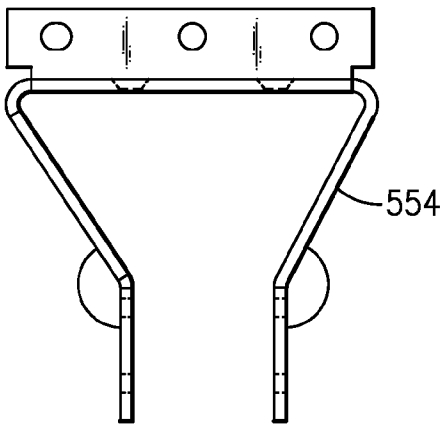
FIG. 30 is an orthographic back side view of component 554.
Figure 29:
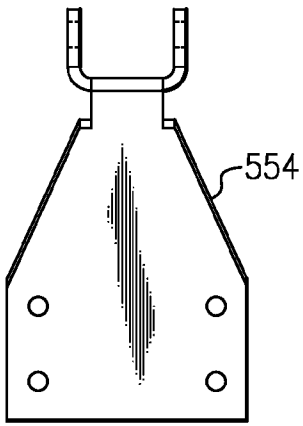
FIG. 29 is an orthographic end view of component 554.
Figure 28:
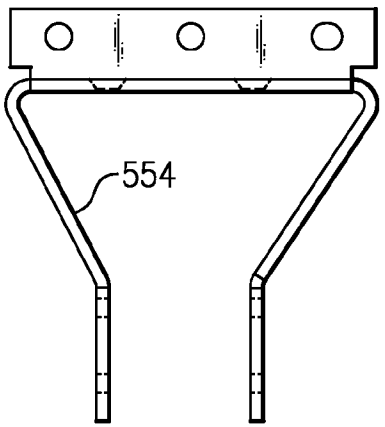
FIG. 28 is an orthographic front side view of component 554.

As shown in FIG. 24, hexagonal shaft-and-bore coupling hardware set 530 includes motor-side coupling hardware 530*a* and drum-side coupling hardware 530*b*. The outer surface of motor-side coupling hardware 530*a*, the inner surface of drum-side coupling hardware 530*b*, the outer surface of drum-side coupling hardware 530*b*, the inner surface of part of shaft 509 shown in FIG. 24, and the outer surface of the part of shaft shown in FIG. 24 are all preferably hexagonal in shape. This shape permits both radial and torsional loads to be transmitted through the coupling, which is a feature that is important in many hoist applications.

FIGS. 25 to 30 show a variation on system 500 where a U-shaped bracket 554 is used in place of the brackets 552 and 572. However, similar to brackets 552 and 572, U-shaped bracket 554 is used to hold bushings in place relative to the frame so that the bushings can support the mounting bar of the bearing assembly in a way that provides the desired kinematic degrees of freedom/constraint.

DEFINITIONS

The following definitions are provided to facilitate claim interpretation:

Present invention: means at least some embodiments of the present invention; references to various feature(s) of the "present invention" throughout this document do not mean that all claimed embodiments or methods include the referenced feature(s).

First, second, third, etc. ("ordinals"): Unless otherwise noted, ordinals only serve to distinguish or identify (e.g., various members of a group); the mere use of ordinals implies neither a consecutive numerical limit nor a serial limitation.

Mechanically connected: Includes both direct mechanical connections, and indirect mechanical connections made through intermediate components; includes rigid mechanical connections as well as mechanical connection that allows for relative motion between the mechanically connected components; includes, but is not limited, to welded connections, solder connections, connections by fasteners (for example, nails, bolts, screws, nuts, hook-and-loop fasteners, knots, rivets, force fit connections, friction fit connections, connections secured by engagement added by gravitational forces, quick-release connections, pivoting or rotatable connections, slidable mechanical connections, latches and/or magnetic connections).

Rigid: at least substantially rigid, but not necessarily ideally rigid.

Rigidly mechanically connected: a mechanical connection (see DEFINITIONS section) that is rigid (see DEFINITIONS section) with respect to all six (60 degrees of freedom/constraint.

Receive/provide/send/input/output: unless otherwise explicitly specified, these words should not be taken to imply: (i) any particular degree of directness with respect to the relationship between their objects and subjects; and/or (ii) absence of intermediate components, actions and/or things interposed between their objects and subjects.

Figure 3:
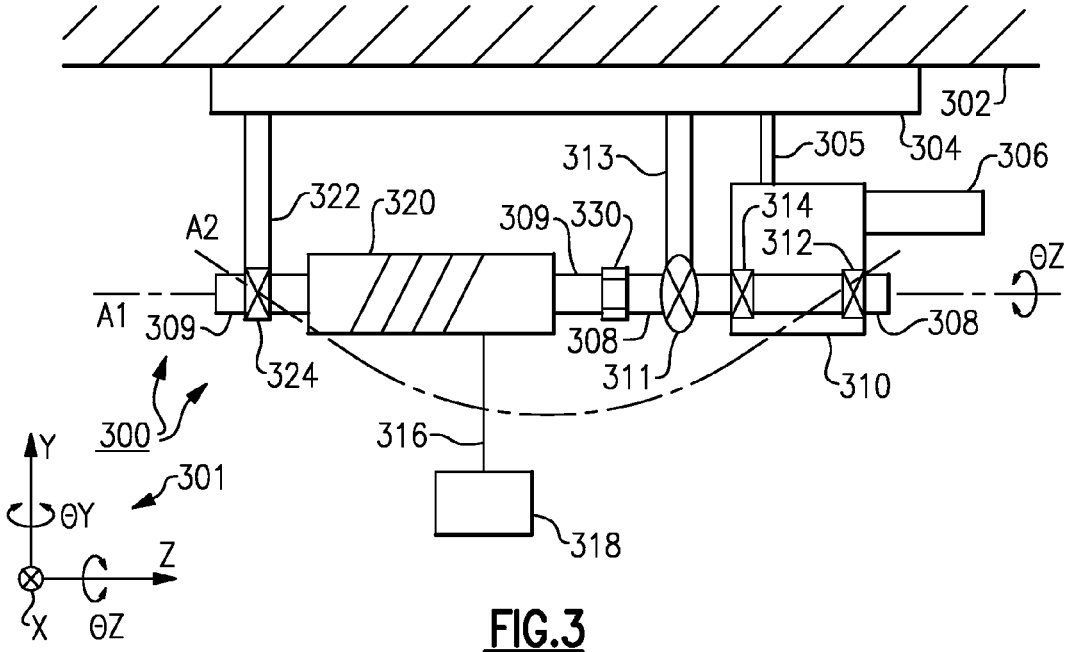
FIG. 3 is a side view of a first embodiment of a hoist system according to the present invention.
Figure 9:
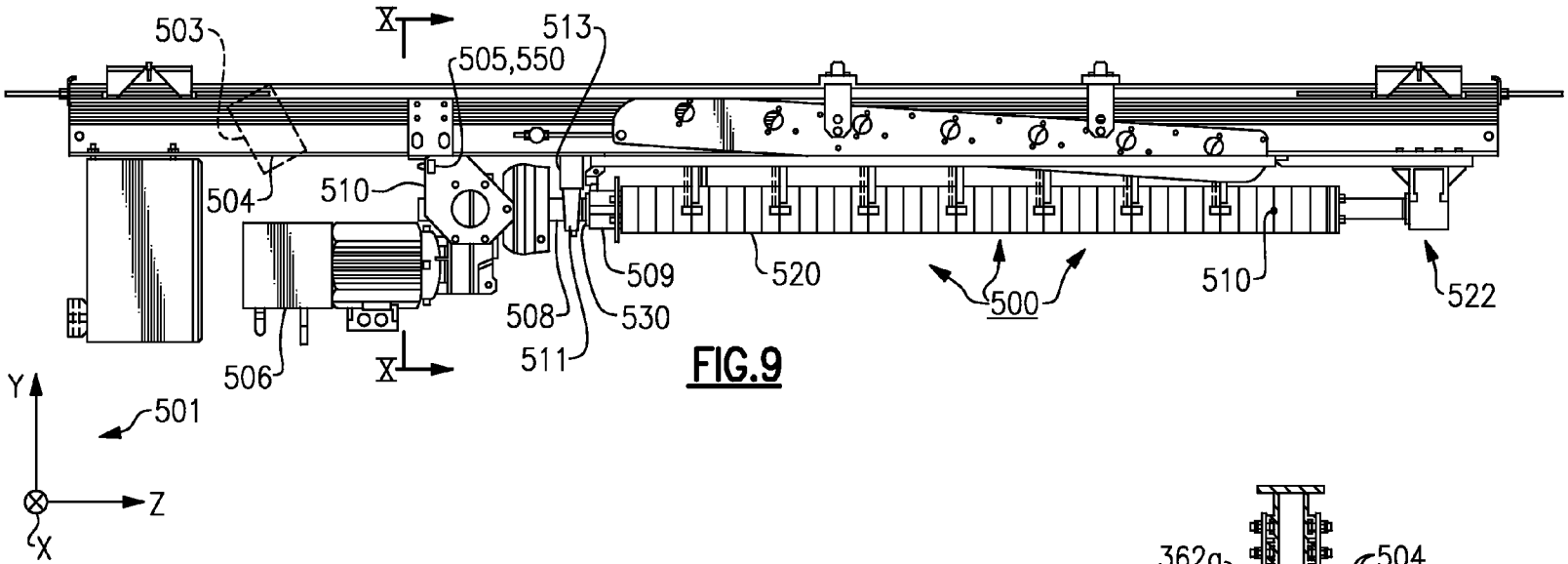
FIG. 9 is a side view of a third embodiment of a hoist system according to the present invention.

X-direction, Y-direction, Z-direction: are defined by the shaft and backbone or frame of a hoist substantially as shown in FIGS. 3, 4 and 9, with Z being the direction of the axis of rotation of the shaft, Y being a direction perpendicular to Z and from the Z-axis toward the backbone or frame and X being orthogonal to Y and Z.

Constraint points: are defined by the shape of mechanical interfaces that provide relative restraint; a constraint point does not necessarily lie inside the body of the component or assembly for which it is defined.

Figure 2:
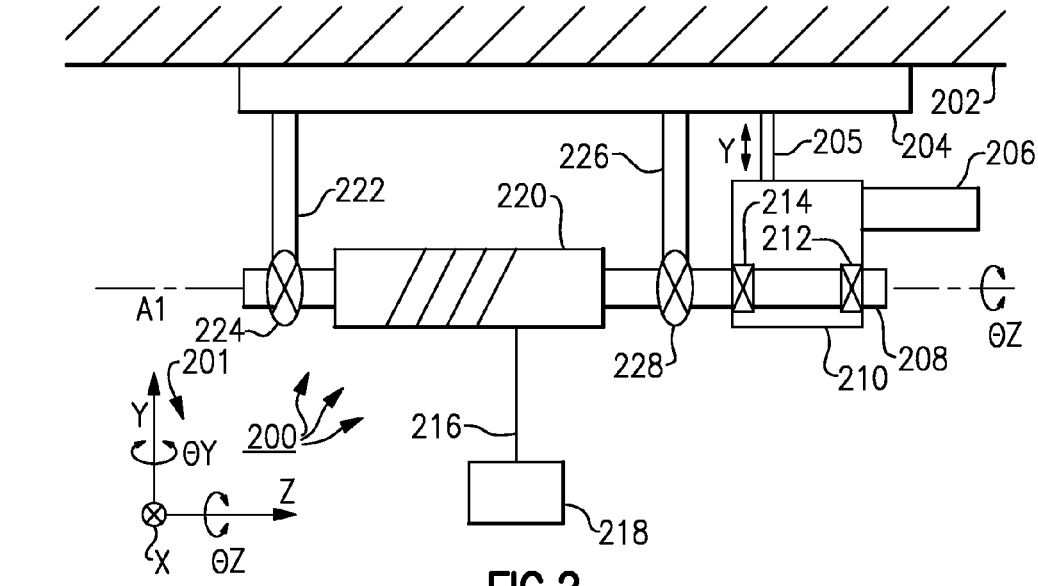
FIG.2 Prior Art
FIG. 2 is a side view of a second conventional hoist system.

Pillow block bearing: any hardware for supporting a rotating shaft segment so that it has the following degrees of freedom/constraint: (i) along-X (see FIGS. 1 and 2) fixed; (ii) along-Y fixed; (iii) along-Z fixed; (iv) θX free; (v) θY free; and (vi) θZ free; pillow block bearings include, but are not necessarily limited to devices commonly called pillow block bearings and spherical roller bearings.

Rigid bearing: a bearing that is rigid (see definitions section) in all directions except: (i) it allows rotation of the shaft about Z; and (ii) it may or may not allow the shaft to move in the along-Z direction.

Bearing: includes, but is not necessarily limited to, pillow block type bearings (see DEFINITIONS section) and rigid type bearings (see DEFINITIONS section).

Frame: frames include but are not limited to frames in the form of a backbone.

To the extent that the definitions provided above are consistent with ordinary, plain, and accustomed meanings (as generally shown by documents such as dictionaries and/or technical lexicons), the above definitions shall be considered supplemental in nature. To the extent that the definitions provided above are inconsistent with ordinary, plain, and accustomed meanings (as generally shown by documents such as dictionaries and/or technical lexicons), the above definitions shall control. If the definitions provided above are broader than the ordinary, plain, and accustomed meanings in some aspect, then the above definitions shall be considered to broaden the claim accordingly.

To the extent that a patentee may act as its own lexicographer under applicable law, it is hereby further directed that all words appearing in the claims section, except for the above-defined words, shall take on their ordinary, plain, and accustomed meanings (as generally shown by documents such as dictionaries and/or technical lexicons), and shall not be considered to be specially defined in this specification. In the situation where a word or term used in the claims has more than one alternative ordinary, plain and accustomed meaning, the broadest definition that is consistent with technological feasibility and not directly inconsistent with the specification shall control.

Unless otherwise explicitly provided in the claim language, steps in method steps or process claims need only be performed in the same time order as the order the steps are recited in the claim only to the extent that impossibility or extreme feasibility problems dictate that the recited step order (or portion of the recited step order) be used. This broad interpretation with respect to step order is to be used regardless of whether the alternative time ordering(s) of the claimed steps is particularly mentioned or discussed in this document.

What is claimed is:

1. A hoist system defining X, Y and Z directions, the system comprising: a frame, a first shaft segment, a first bearing assembly, a first-assembly connection hardware set and a second bearing assembly, wherein:

the first bearing assembly is mechanically connected to the frame by the first-assembly connection hardware set;

the first bearing assembly comprises a first bearing;

the second bearing assembly is rigidly mechanically connected to the frame;

the second bearing assembly comprises a second bearing located to be spaced apart from the first bearing;

the second bearing is a pillow block bearing;

the first bearing and the second bearing are shaped, sized and located to support and constrain the first shaft segment so that the first shaft segment is free to rotate about the Z direction;

the first-assembly connection hardware set defines a first constraint point and a second constraint point spaced apart from the first constraint point;

the first-assembly connection hardware set is sized, shaped, located and/or connected so that the first bearing assembly has, relative to the frame and with respect to the first constraint point, the following degrees of freedom/constraint: (i) fixed or free in along X; (ii) free in rotation about X; (iii) fixed in along Y; (iv) free in rotation about Y; (v) free in along Z; and (vi) free in rotation about Z; and the first-assembly connection hardware set is further sized, shaped, located and/or connected so that the first bearing assembly has, relative to the frame and with respect to the second constraint point, the following degrees of freedom/constraint: (i) fixed in along X; (ii) free in rotation about X; (iii) fixed in along Y; (iv) free in rotation about Y; (v) free in along Z; and (vi) free in rotation about Z.

2. The system of claim 1 wherein the first-assembly connection hardware is further structured, located and/or connected so that the first bearing assembly has, relative to the frame and with respect to the first constraint point, the following further degree of freedom/constraint: free in along X.

3. The system of claim 1 wherein the first-assembly connection hardware is further structured, located and/or connected so that the first bearing assembly has, relative to the frame and with respect to the first constraint point, the following further degree of freedom/constraint: fixed in along X.

4. The system of claim 1 wherein the first bearing assembly further comprises a third bearing, wherein:

the third bearing is located to be spaced apart from the first bearing so that the first bearing is located between, and at least substantially coaxial with, the second bearing and the third bearing; and the third bearing is shaped, sized and located to further support and constrain the first shaft segment so that the first shaft segment is free to rotate about the Z direction.

5. The system of claim 4 wherein:

the first bearing is a rigid bearing;

the first bearing is rigidly mechanically connected to the first bearing assembly;

the third bearing is a rigid bearing; and the third bearing is rigidly mechanically connected to the first bearing assembly.

6. The system of claim 1 further comprising: a second shaft segment and a shaft coupling hardware set, wherein:

the shaft coupling hardware set couples the first shaft segment and the second shaft segment so that they rotate together about the Z direction; and the shaft coupling hardware transmits only radial loads and loads in torsion.

7. The system of claim 6 further comprising: a third bearing assembly, wherein:

the third bearing assembly comprises a third bearing;

the third bearing is at least substantially coaxial with the first bearing and the second bearing; and the third bearing is shaped, sized and located to support and constrain the second shaft segment so that the second shaft segment is free to rotate about the Z direction.

8. The system of claim 7 wherein:

the third bearing assembly is rigidly mechanically connected to the frame;

the third bearing is rigidly mechanically connected to the third bearing assembly; and the third bearing is a rigid bearing.

9. The system of claim 7 further comprising a drum and a cable, wherein:

the drum is rigidly mechanically connected to the second shaft segment so that the drum rotates about Z with the second shaft segment;

the drum is located between the third bearing and the second bearing; and the cable is sized, shaped and located so that rotation of the drum about the Z direction winds and unwinds the cable from the drum.

10. The system of claim 9 further comprising a motor, wherein:

the motor is mechanically connected to the first shaft segment so that the motor drives the first shaft segment, the second shaft segment and the drum to rotate about the Z direction; and the motor is mechanically connected to and supported by the first bearing assembly.

11. The system of claim 10 further comprising a reducer hardware set, wherein:

the reducer hardware set is shaped, sized and located to mechanically connected the motor to the first shaft segment so that the motor drives the first shaft segment, the second shaft segment and the drum to rotate about the Z direction; and the reducer hardware set is mechanically connected to and supported by the first bearing assembly.

12. A hoist system defining X, Y and Z directions, the system comprising: a frame, a first shaft segment, a first bearing assembly, a first-assembly connection hardware set, a second bearing assembly, a second shaft segment and a shaft coupling hardware set, wherein:

the first bearing assembly is mechanically connected to the frame by the first-assembly connection hardware set;

the first bearing assembly comprises a first bearing;

the second bearing assembly is rigidly mechanically connected to the frame;

the second bearing assembly comprises a second bearing located to be spaced apart from the first bearing;

the second bearing is a pillow block bearing;

the first bearing and the second bearing are shaped, sized and located to support and constrain the first shaft segment so that the first shaft segment is free to rotate about the Z direction;

the first-assembly connection hardware set defines a first constraint point and a second constraint point spaced apart from the first constraint point;

the first-assembly connection hardware set is sized, shaped, located and/or connected so that the first bearing assembly has, relative to the frame and with respect to the first constraint point, the following degrees of freedom/constraint: (i) fixed or free in along X; (ii) free in rotation about X; (iii) fixed in along Y; (iv) free in rotation about Y; (v) free in along Z; and (vi) free in rotation about Z;

the first-assembly connection hardware set is further sized, shaped, located and/or connected so that the first bearing assembly has, relative to the frame and with respect to the second constraint point, the following degrees of freedom/constraint: (i) fixed in along X; (ii) free in rotation about X; (iii) fixed in along Y; (iv) free in rotation about Y; (v) free in along Z; and (vi) free in rotation about Z;

the shaft coupling hardware set couples the first shaft segment and the second shaft segment so that they rotate together about the Z direction; and the shaft coupling hardware transmits only radial loads and loads in torsion.

13. The system of claim 12 further comprising: a third bearing assembly, wherein:

the third bearing assembly comprises a third bearing;

the third bearing is at least substantially coaxial with the first bearing and the second bearing; and the third bearing is shaped, sized and located to support and constrain the second shaft segment so that the second shaft segment is free to rotate about the Z direction.

14. The system of claim 13 wherein:

the third bearing assembly is rigidly mechanically connected to the frame;

the third bearing is rigidly mechanically connected to the third bearing assembly; and the third bearing is a rigid bearing.

15. The system of claim 13 further comprising a drum and a cable, wherein:

the drum is rigidly mechanically connected to the second shaft segment so that the drum rotates about Z with the second shaft segment;

the drum is located between the third bearing and the second bearing; and the cable is sized, shaped and located so that rotation of the drum about the Z direction winds and unwinds the cable from the drum.

16. The system of claim 15 further comprising a motor, wherein:

the motor is mechanically connected to the first shaft segment so that the motor drives the first shaft segment, the second shaft segment and the drum to rotate about the Z direction; and the motor is mechanically connected to and supported by the first bearing assembly.

17. The system of claim 16 further comprising a reducer hardware set, wherein:

the reducer hardware set is shaped, sized and located to mechanically connected the motor to the first shaft segment so that the motor drives the first shaft segment, the second shaft segment and the drum to rotate about the Z direction; and the reducer hardware set is mechanically connected to and supported by the first bearing assembly.

18. A hoist system defining X, Y and Z directions, the system comprising: a backbone, a motor, a hoist hardware set, a first shaft segment, a motor-end bearing assembly, a motor-end-assembly connection hardware set and a pillow block bearing assembly, wherein:

the hoist hardware set is mechanically connected to an end of the first shaft segment;

the motor is rigidly mechanically connected to the motor end bearing assembly;

the motor is structured, located and/or connected to drive the first shaft segment to rotate about Z;

the motor-end bearing assembly is mechanically connected to the backbone by the motor-end-assembly connection hardware set;

the motor-end bearing assembly comprises a first motor-end bearing and a second motor-end bearing;

the intermediate bearing assembly is rigidly mechanically connected to the backbone;

the intermediate bearing assembly comprises a pillow block bearing located to be spaced apart from, and at least substantially co-axial with, the first motor end-end bearing and the second motor-end bearing;

the pillow block bearing, the first motor-end bearing and the second motor-end bearing are shaped, sized and located to support and constrain the first shaft segment so that the first shaft segment is free to rotate about the Z direction;

the motor-end-assembly connection hardware set defines a first constraint point and a second constraint point spaced apart from the first constraint point;

the motor-end-assembly connection hardware set is sized, shaped, located and/or connected so that the motor-end bearing assembly has, relative to the backbone and with respect to the first constraint point, the following degrees of freedom/constraint: (i) fixed or free in along X; (ii) free in rotation about X; (iii) fixed in along Y; (iv) free in rotation about Y; (v) free in along Z; and (vi) free in rotation about Z; and the motor-end-assembly connection hardware set is further sized, shaped, located and/or connected so that the first bearing assembly has, relative to the backbone and with respect to the second constraint point, the following degrees of freedom/constraint: (i) fixed in along X; (ii) free in rotation about X; (iii) fixed in along Y; (iv) free in rotation about Y; (v) free in along Z; and (vi) free in rotation about Z.

19. The system of claim 18 wherein the motor-end assembly connection hardware set comprises: a first bushing, a second bushing and a mounting bar, wherein:

the first bushing is rigidly mechanically constrained with respect to the backbone;

the second bushing is rigidly mechanically constrained with respect to the backbone;

the mounting bar defines a first hole and a second hole;

the first hole is sized, shaped and located so that the first bushing extends through first hole and the mounting bar is slidable in at least the along-Z direction over the first bushing;

the second hole is sized, shaped and located so that the second bushing extends through second hole and the mounting bar is slidable in at least the along-Z direction over the second bushing; and the mounting bar is rigidly mechanically connected to the motor-end bearing assembly.

20. The system of claim 19 wherein the first hole is in the shape of a slot elongated in the along-X direction.

21. A hoist system defining X, Y and Z directions, the system comprising: a frame, a first shaft segment, a first bearing assembly, a first-assembly connection hardware set and a second bearing assembly, wherein:

the first bearing assembly is mechanically connected to the frame by the first-assembly connection hardware set;

the first bearing assembly comprises a first bearing;

the second bearing assembly is rigidly mechanically connected to the frame;

the second bearing assembly comprises a second bearing located to be spaced apart from the first bearing;

the second bearing is a pillow block bearing;

the first bearing and the second bearing are shaped, sized and located to support and constrain the first shaft segment so that the first shaft segment is free to rotate about the Z direction;

the first-assembly connection hardware set defines a first constraint point and a second constraint point spaced apart from the first constraint point;

the first-assembly connection hardware set is sized, shaped, located and/or connected so that such that it will transmit, from the first bearing assembly to the frame, forces parallel with the X axis, forces parallel with the Y axis, and moments about the Z axis; and the first-assembly connection hardware set is further sized, shaped, located and/or connected so that such that it will not transmit forces in the Z direction, moments about the X axis, or moments about the Y axis.

22. A method of hoisting an object, the method comprising the following steps:

providing a hoist system defining X, Y and Z directions, the system comprising: a frame, a first shaft segment, a first bearing assembly, a first-assembly connection hardware set and a second bearing assembly, wherein:

the first bearing assembly is mechanically connected to the frame by the first-assembly connection hardware set, the first bearing assembly comprises a first bearing, the second bearing assembly is rigidly mechanically connected to the frame the second bearing assembly comprises a second bearing located to be spaced apart from the first bearing, the second bearing is a pillow block bearing, the first bearing and the second bearing are shaped, sized and located to support and constrain the first shaft segment so that the first shaft segment is free to rotate about the Z direction, and the first-assembly connection hardware set defines a first constraint point and a second constraint point spaced apart from the first constraint point; and hoisting a load so that: (i) the first constraint point is free in rotation about X; (ii) the first constraint point is fixed in along Y; (iii) the first constraint point is free in rotation about Y; (iv) the first constraint point is free in along Z; (v) the first constraint point is free in rotation about Z; (vi) the second constraint point is fixed in along X; (vii) the second constraint point is free in rotation about X; (viii) the second constraint point is fixed in along Y; (ix) the second constraint point is free in rotation about Y; (x) the second constraint point is free in along Z; and (xi) the second constraint point is free in rotation about Z.

* * * * *